US007364450B2

(12) United States Patent
Hafner et al.

(10) Patent No.: US 7,364,450 B2
(45) Date of Patent: Apr. 29, 2008

(54) PLUG-IN CONNECTOR

(75) Inventors: Franz Hafner, Oppenweiler (DE); Andreas Schuffenhauer, Chemnitz (DE); Friedemann Junghanns, Thum (DE)

(73) Assignee: Murr-Elektronik GmbH, Oppenweiler (DE)

( * ) Notice: Subject to any disclaimer, the term of this patent is extended or adjusted under 35 U.S.C. 154(b) by 319 days.

(21) Appl. No.: 11/161,686

(22) Filed: Aug. 12, 2005

(65) Prior Publication Data

US 2006/0033218 A1 Feb. 16, 2006

(30) Foreign Application Priority Data

Aug. 12, 2004 (DE) ..... 10 2004 039 580

(51) Int. Cl.
*H01R 4/38* (2006.01)

(52) U.S. Cl. ..... 439/255; 439/263; 439/253; 439/256

(58) Field of Classification Search ..... 439/253–256, 439/263

See application file for complete search history.

(56) References Cited

U.S. PATENT DOCUMENTS 3,430,184 A * 2/1969 Acord ..... 439/255
3,452,316 A * 6/1969 Mocek et al. ..... 439/255
4,919,627 A 4/1990 Cable ..... 439/261
4,941,846 A * 7/1990 Guimond et al. ..... 439/578
5,013,254 A * 5/1991 Williams et al. ..... 439/255
5,192,219 A 3/1993 Fowler et al. ..... 439/321
5,514,001 A * 5/1996 Szegda ..... 439/263
6,247,956 B1 6/2001 Proter, Jr. ..... 439/352
6,267,612 B1 * 7/2001 Arcykiewicz et al. ..... 439/253
6,769,926 B1 8/2004 Montena ..... 439/253

FOREIGN PATENT DOCUMENTS

DE 101 21 675 11/2001

* cited by examiner

*Primary Examiner*—Tho D. Ta
(74) *Attorney, Agent, or Firm*—Gudrun E. Huckett

(57) ABSTRACT

A plug-in connector has a plug member and a locking device for securing the plug member on a counterpart. The locking device has at least one locking element having a release position and a locking position, wherein in the release position the plug member is removable from the counterpart and wherein in the locking position the plug member and the counterpart are locked relative to one another. An actuating element acting on the locking device is provided for moving the at least one locking element from the release position into the locking position in a radial direction relative to a longitudinal axis of the plug member.

20 Claims, 12 Drawing Sheets

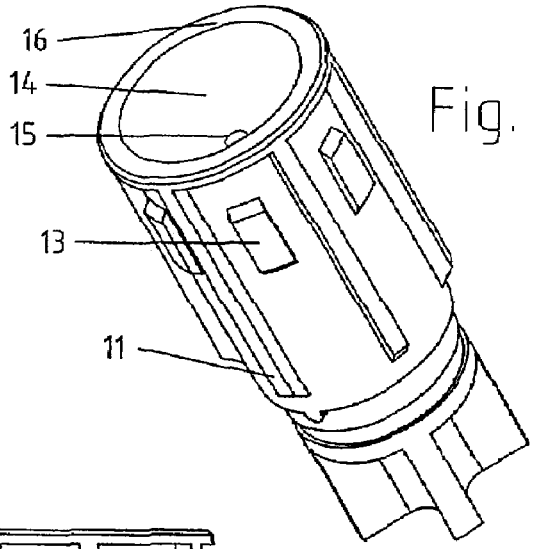
Fig. 5
Fig. 6
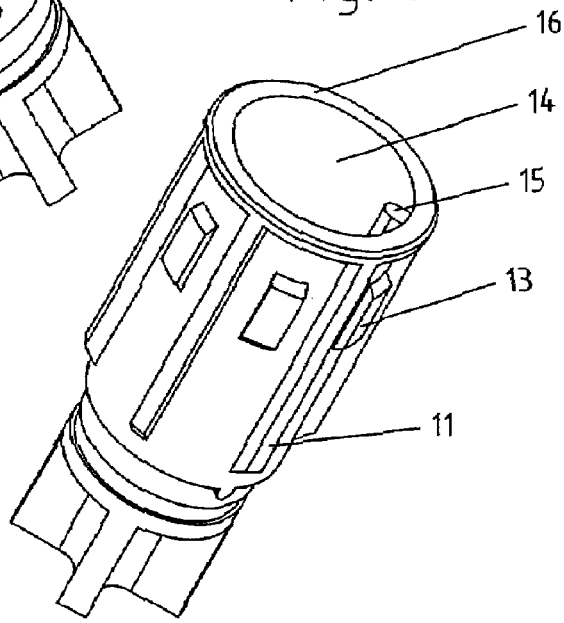
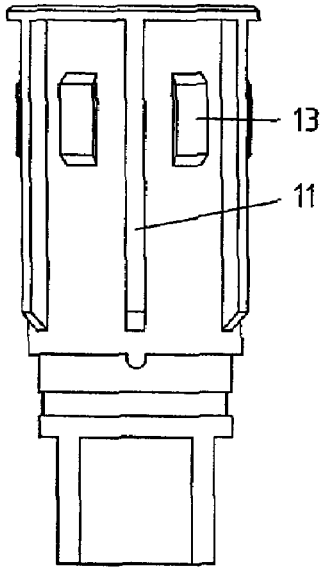
Fig. 3
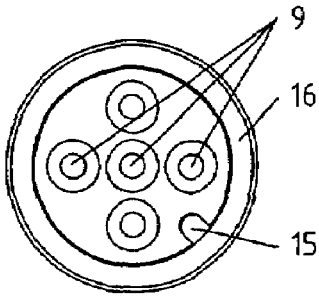
Fig. 2
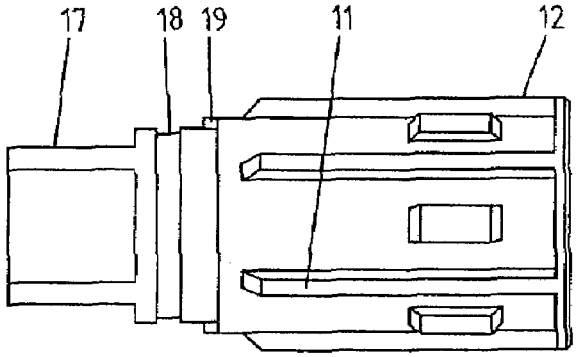
Fig. 4

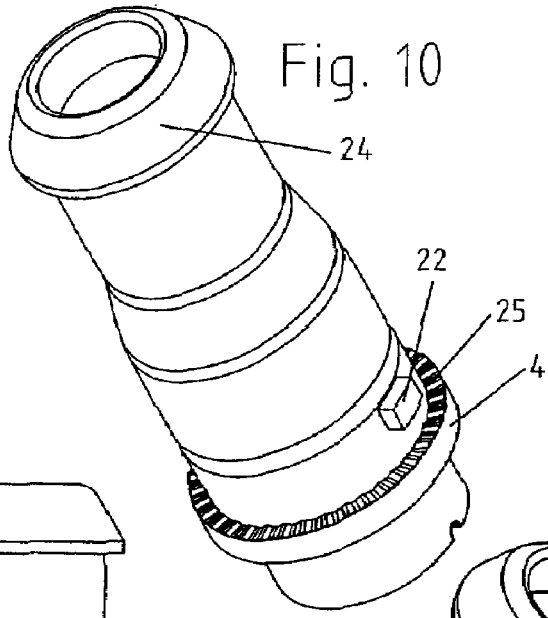
Fig. 10
Fig. 8
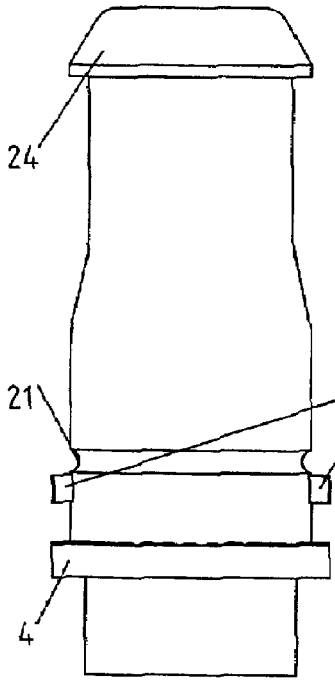
Fig. 11
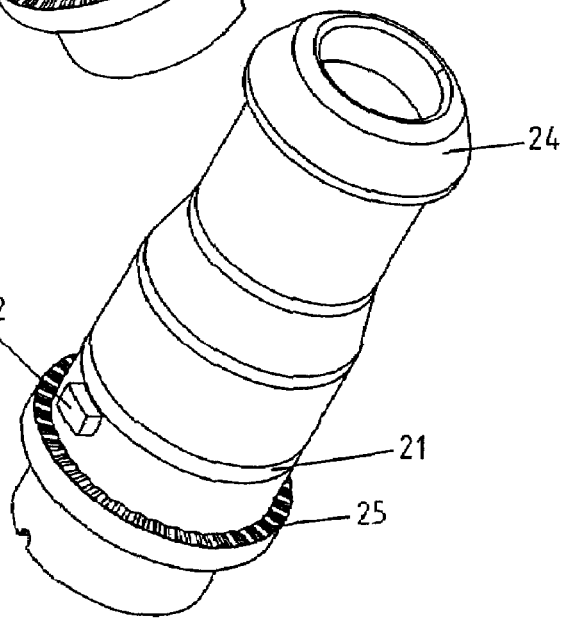
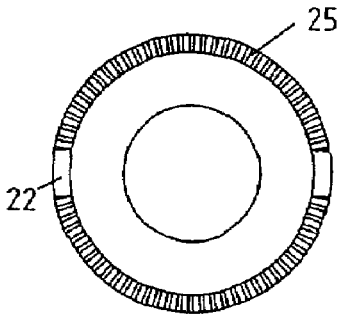
Fig. 7
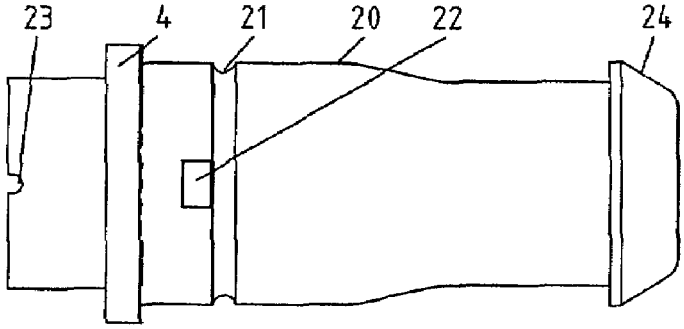
Fig. 9

Fig. 15
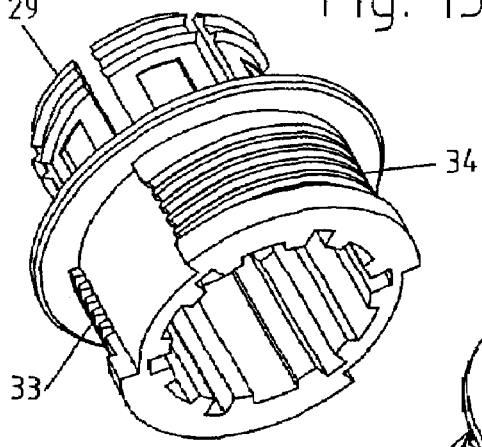
Fig. 16
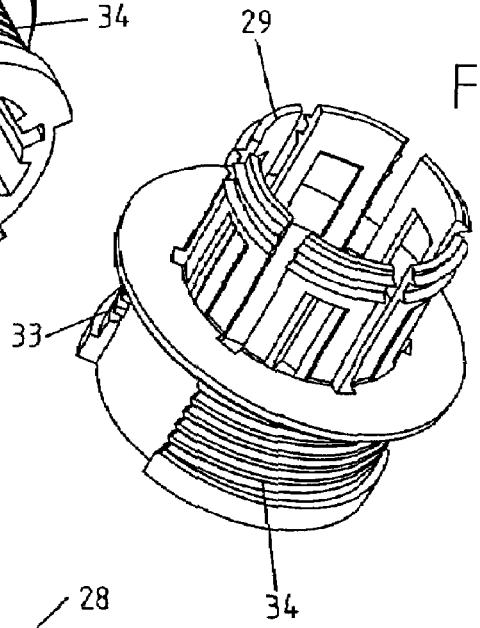
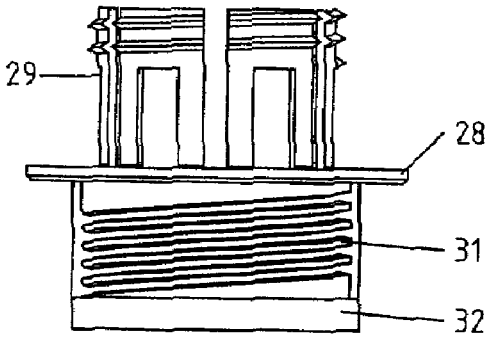
Fig. 13
Fig. 14
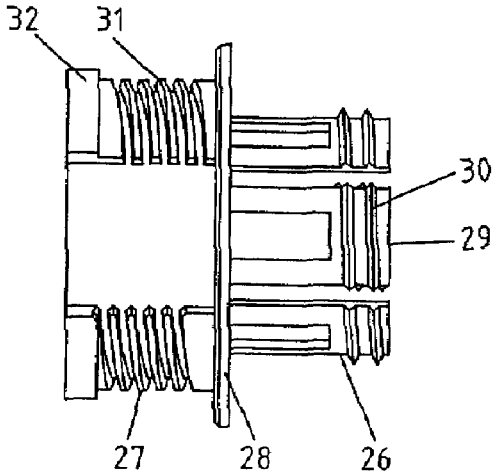
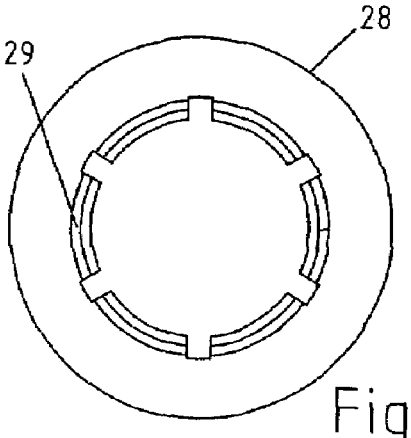
Fig. 12

PLUG-IN CONNECTOR

BACKGROUND OF THE INVENTION

The invention relates to a plug-in connector comprising a plug member to be secured on a counterpart by a locking device. The locking device has at least one locking element that, in an release position, enables detaching the plug member and the counterpart from one another and, in a locking position, locks the plug member and the counterpart relative to one another.

A plug-in connector with a locking device between the plug member and the counterpart is disclosed, for example, in DE 101 21 675 A1. The locking device of this plug-in connector is realized by a snap-on connection between plug member and counterpart. A lock sleeve is provided for the locking action. The lock sleeve is supported so as to be longitudinally slidable on the outer circumference of the snap-on element; in its locking position, the lock sleeve prevents outward pivoting of a snap hook and, in this way, locks the plug member and the counterpart relative to one another. A disadvantage of such a plug-in connector is that the plug member and counterpart must be matched relative to one another so that a plug member provided with the snap-on element cannot be connected to a counterpart that is not provided with an appropriate locking element.

DE 101 21 675 A1 discloses also that the snap-on element can be snapped into place on the outer thread of a counterpart. In order to ensure a sufficient tightness of the connection, the plug member must be inserted until it rests against a seal or gasket that is provided at the bottom of the counterpart. When doing so, the snap hook passes across the entire length of the thread. The snap hook is deflected when passing across the thread. The deflection of the snap hook is thus performed in a direction from the locking position into the release position. Accordingly, when inserting plug member and counterpart into one another, the user must additionally overcome the deflection force of the snap hook. A sufficient pressing action of plug member and counterpart for reaching a seal-tight connection can therefore not be ensured.

SUMMARY OF THE INVENTION

It is an object of the present invention to provide a plug-in connector of the aforementioned kind which enables a simple and safe connection of plug member and counterpart.

In accordance with the present invention, this is achieved in that the plug-in connector has an actuating means for the locking element, wherein the actuating means deflects the locking element from the release position into the locking position in a radial direction relative to the longitudinal axis of the plug member.

The locking element is deflected by the actuating means from the release position into the locking position. In this way, when pushing plug member and counterpart into one another, no additional force must be overcome. Plug member and counterpart can be connected with one another and subsequently can be locked relative to one another by deflection of the locking element. In this way, a simple and safe connection of plug member and counterpart is enabled. In the context of the present invention, the plug member can be a plug or a plug receptacle (socket) and the counterpart can be a plug receptacle (socket) or a plug.

Advantageously, the actuating means secures the locking element in the locking position in its radially deflected position. In this way, an accidental release of the locking element can be prevented. An additional securing means is not required because the actuation as well as the securing action in the locking position is realized by the actuating means. Preferably, the locking element is arranged on the plug member and interacts with a threaded section provided on the counterpart. In this connection, it is provided that the locking element in the locking position engages the threaded section and in the release position is disengaged from the threaded section. The plug member can be a plug member as well as a socket. In accordance with this, the counterpart is either a socket or a plug member. Since the locking element interacts with a threaded section, no special locking means or the like are required so that the counterpart can be a customary plug member or a customary socket that must not be specially matched to the locking element. In this way, it is possible to employ the plug-in connector according to the invention in connection with conventional counterparts without having to replace the entire plug-in connector. Since the locking element in the release position is disengaged from the threaded section, only minimal insertion forces must be overcome for connecting plug member and counterpart, and it can be ensured that the plug member and counterpart are connected sufficiently securely to one another in order to achieve a safe connection.

Preferably, the locking element has a springy configuration and is in the release position when in the unloaded state. The locking element is preferably provided on a lock sleeve that is movably supported in at least one direction on a support body of the plug member. In this way, a simple configuration results that requires only minimal mounting space.

Because of the configuration as a sleeve, the locking device can also be arranged on the part that supports the outer thread of the plug-in connector for which only a minimal mounting space is available. Advantageously, several locking elements are provided that are uniformly distributed about the circumference of the lock sleeve. A simple configuration results when the locking elements are springs that are separated from one another by longitudinal slots in the lock sleeve. The longitudinal slots enable a radial deflection of the individual spring elements. Preferably, the actuating means is arranged on the support body. In this way, only a few components are required for the plug-in connector. Preferably, the lock sleeve replaces a threaded sleeve having an outer thread or the union nut having an inner thread as they are provided in customary plug-in connectors so that the plug-in connector according to the invention can be produced with the same number of parts as a plug-in connector without locking device.

It is provided that the plug member has a contact carrier for receiving plug contacts wherein the lock sleeve is supported on the contact carrier and the locking element in the locking position is deflected radially outwardly. Preferably, the actuation means is a widened portion or enlargement on the outer circumference of the contact carrier. However, it can also be provided that the contact carrier is a bushing part and the locking element in the locking position is deflected radially inwardly. The locking element is preferably arranged inwardly of an inner circumference of an actuating sleeve and the actuating means is an enlargement on the inner circumference of the actuating sleeve. A minimal number of components can be achieved when the actuating sleeve and the bushing part form a unitary (monolithic) part.

Preferably, the lock sleeve is rotatable about the contact carrier. The rotational movement of the lock sleeve effects an engagement of the locking elements on the actuating means and a radial deflection of the locking element. The engagement of the locking element in a threaded section of the counterpart effects in combination with the rotational movement of the lock sleeve a further tightening of the plug member and counterpart so that a fixed connection of plug member and counterpart is ensured in this way. In this connection, the locking element is configured especially also as a thread. It can also be provided that the locking element is a thread and interacts with an element of the counterpart that is not configured as a thread. Expediently, as least one stop is provided that limits the relative movement between the lock sleeve and the contact carrier.

Preferably, the plug-in connector has a locking connection between the plug member provided with plug member contacts and a socket provided with socket contacts wherein a contact carrier of the plug member surrounds or encloses the plug contacts and supports a threaded sleeve that is longitudinally movable on its outer circumference but is radially immobile. In this connection, it is provided that the terminal area of the threaded sleeve on the plug member is designed to be radially movable and the leading end of the contact carrier on the plug member has at least one spreading means that, when realizing the locking connection of the plug member and the socket part, spreads the terminal area of the threaded sleeve and presses the terminal area against the inner wall of the bushing part that has been pushed onto the leading end of the contact carrier.

The movement of the plug member into the threaded sleeve causes the bushing part that has been pushed onto the contact carrier and pressed against the threaded sleeve to be connected by means of a clamping connection fixedly with the plug member. A further configuration of the invention is designed such that the terminal area of the threaded sleeve is slotted longitudinally several times and, in this way, several springs are formed so that the spreading means are formed by longitudinal webs that interact with the springs. The springs are spread apart in a simple way by the webs positioned underneath when the contact carrier is correspondingly moved against the threaded sleeve.

According to a further configuration of the invention, the springs have on their free terminal area an annular tooting. It is matched to an annular tooting provided on the inner side of the bushing part (usually designed as an inner tooting). In this way, locking of the bushing part on the plug member is made even more secure. Preferably, the annular tooting on the springs is embodied as a threaded segment.

According to an expedient further configuration of the invention, the relative movement between the contact carrier and the threaded sleeve lock is realized by means of a union nut that interacts by means of an annular stop with the contact carrier and by means of an inner threaded with the outer thread of the threaded lock sleeve.

According to a further configuration of the invention, on the end of the contact carrier facing away from the plug member a sleeve-shaped housing is attached that is provided with a collar whose side that is facing away from the plug member is a counter ring stop for the ring stop of the union nut. Such a configuration of contact carrier, housing, and union nut is advantageous with regard to assembly.

According to a further configuration of the invention, the counter ring stop and the ring stop have radial ribbing. When the plug member and the socket part are locked with one another, the ribbing ensures that the union nut will not become loose when the plug-in connector is subjected to vibrations.

According to a further embodiment of the invention, the union nut in the non-spread state of the springs is disengaged from the outer thread of the threaded lock sleeve and the union nut and the housing in this state have effective locking means as an anti-rotation means of the union nut. Manipulation of the plug member and bushing part for the locking action is improved in this way.

In order to ensure the anti-rotation action of the union nut before realizing the locking connection, according to a further configuration of the invention a coil spring is arranged between the threaded lock sleeve and the side of the housing collar facing the bushing part.

According to an expedient further configuration of the invention, the outer thread of the threaded sleeve is divided into segments. According to an expedient additional configuration of the invention, the inner thread of the union nut is divided into segments.

According to an expedient additional configuration of the invention, stops for limiting the rotary angle of the union nut are provided on the housing and within the union nut.

BRIEF DESCRIPTION OF THE DRAWING

FIG. 2 is an end view onto a contact carrier illustrated in FIG. 1.

FIG. 3 is a side view of the contact carrier of FIG. 2.

FIG. 4 is a side view of the contact carrier of FIG. 2 rotated about a 90 degree angle relative to the illustration of FIG. 3.

FIG. 5 is a first perspective view of the contact carrier of FIG. 3 and FIG. 4.

FIG. 6 is a second perspective view of the contact carrier of FIG. 3 and FIG. 4.

FIG. 7 is an end view onto the housing illustrated in FIG. 1.

FIG. 8 is a side view of the housing of FIG. 7.

FIG. 9 is a side view of the housing of FIG. 7 rotated about a 90 degree angle relative to FIG. 8.

FIG. 10 is a first perspective view of the housing of FIG. 8 and FIG. 9.

FIG. 11 is a second perspective view of the housing of FIG. 8 and FIG. 9.

FIG. 12 is an end view onto the threaded lock sleeve illustrated in FIG. 1.

FIG. 13 is a side view of the threaded lock sleeve of FIG. 12.

FIG. 14 is a side view of the threaded lock sleeve of FIG. 12 that is rotated by a 90 degree angle relative to FIG. 13.

FIG. 15 is a first perspective view of the threaded lock sleeve of FIG. 13 and FIG. 14.

FIG. 16 is a second perspective view of the threaded lock sleeve of FIG. 13 and FIG. 14.

DESCRIPTION OF THE PREFERRED EMBODIMENTS

Figure 1:
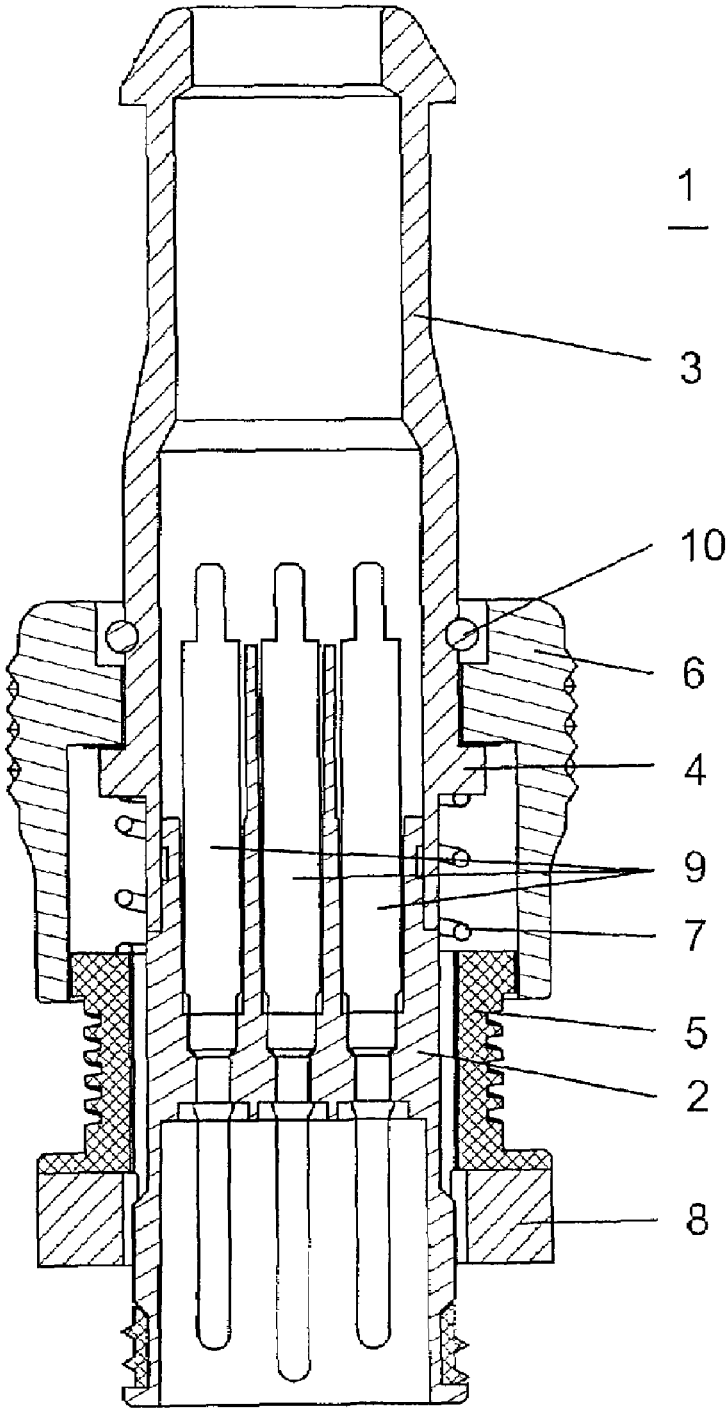
FIG. 1 is a longitudinal section of a plug member of a plug-in connector according to the invention.
Figure 20:
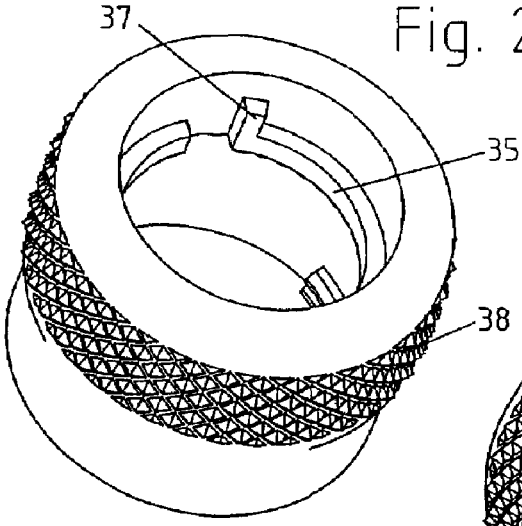
FIG. 20 is a first perspective view of the union nut of FIG. 18 and FIG. 19.
Figure 21:
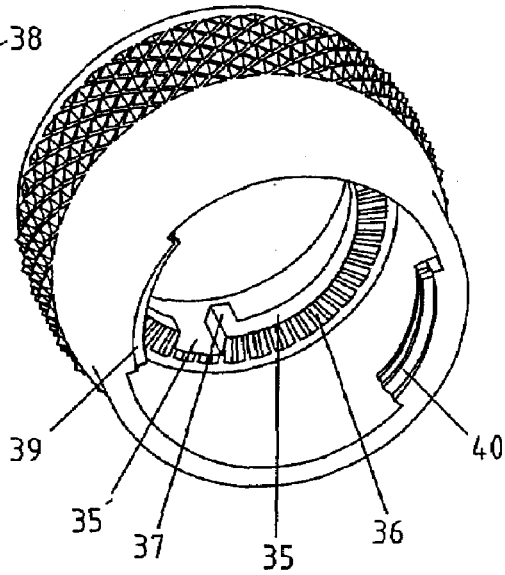
FIG. 21 is a second perspective view of the union nut of FIG. 18 and FIG. 19.
Figure 18:
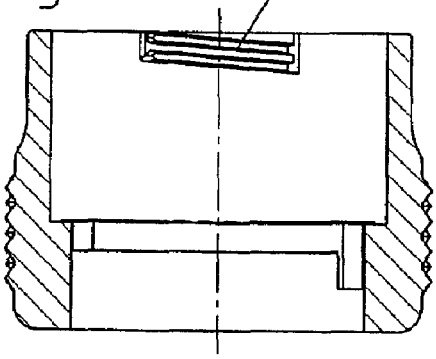
FIG. 18 is a section along section line XVIII of FIG. 17.
Figure 17:
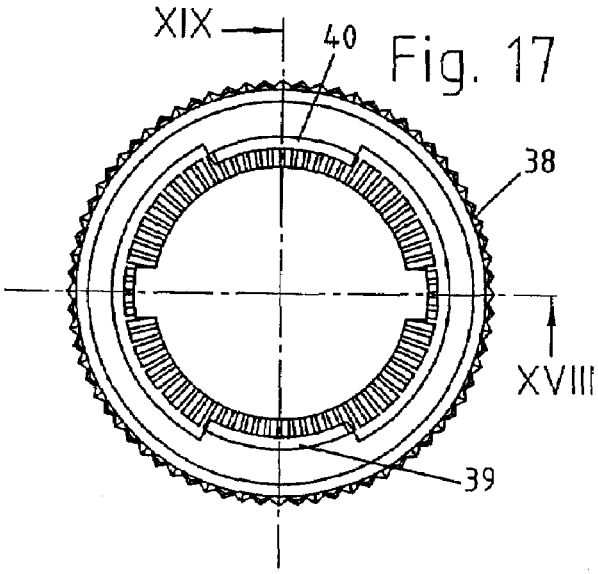
FIG. 17 is a plan view of the union nut illustrated in FIG. 1.
Figure 19:
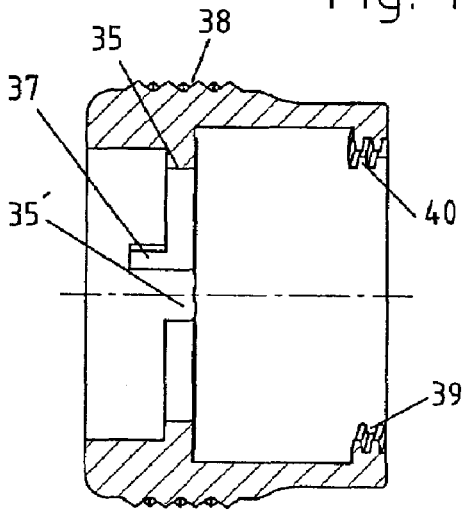
FIG. 19 is a section along section line XIX of FIG. 17.

FIG. 1 shows plug member 1 of a round plug-in connector. The plug member 1 comprises essentially a cylindrical contact carrier 2; a cylindrical housing 3 attached to one end of the contact carrier 2 and provided with a collar 4; a threaded lock sleeve 5 that is arranged on the contact carrier 2 so as to be longitudinally slidable but radially immobile; a union nut 6 engaging the housing 3 and the threaded lock sleeve 5; a coil spring 7 arranged between the threaded lock sleeve 5 and the collar 4; and a rubber ring 8 arranged on a collar of the threaded lock sleeve 5, preferably attached or fastened to this collar. The contact carrier 2 surrounds or encloses plug contacts 9, not illustrated in detail. The union nut 6 is secured by means of a securing ring 10 on the housing 3.

The essential components 2, 3, 5, and 6 of the plug member 1 will be explained in the following in more detail with the aid of FIGS. 2 through 21.

The FIGS. 2 to 6 disclose the configuration of the contact carrier 2 that is of a cylindrical configuration and surrounds in this embodiment five plug contacts, see plug member-contact 9. On its circumference, six guide stays 11 are provided that extend in the longitudinal direction. Between the guide stays 11, at the leading end 12 of the contact carrier 2, six glide bars are distributed circumferentially that extend in the longitudinal direction: see glide bars 13. This leading end of the contact carrier 2 has a cavity 14 for receiving a bushing part wherein a positioning stay 15 ensures correct positioning of the bushing part in the plug member. An annular surface forms the end face 16. The opposed end 17 of the contact carrier 2 is of a four-wing configuration wherein the wings are aligned with the plug contacts 9 and have openings for receiving the cable wires or leads. In the vicinity of the base of the wings an annular groove 18 is formed. Between the annular groove and a step of the contact carrier 2 there are two opposed positioning stays 19 (FIG. 4).

In FIG. 7 through 11, the configuration of the cylindrical housing 3 is illustrated. The housing 3 is provided for receiving the cable, for contacting the cable, and for providing means for cable tension relief (not illustrated). The housing 3 has centrally a widened part 20 that is provided with an annular groove 21 for receiving the securing ring 10 (FIG. 1) and with two stops 22 arranged between the annular groove 21 and the collar 4 for limiting rotation. The leading end of the housing 3 is provided with two cutouts 23 for receiving the positioning stays 19 (FIG. 4) and the rearward end has a wedge-shaped (in cross-section) projecting part 24. One of the rotary limitation stops 22 also serves for locking the union nut 6 in the unlocked state of the plug-in connector. The side of the collar 4 that is facing away from the leading end of the housing 3 is provided with radial ribbing 25.

In FIGS. 12 through 16, the configuration of the threaded lock sleeve 5 is illustrated that has a weaker front part 26 and a stronger rear part 27 (FIG. 14) wherein both parts are separated by a collar 28. The collar 28 supports the rubber ring 8 (not shown in FIGS. 12 through 16 but illustrated in FIG. 1). The front part 26 is slotted six times in the longitudinal direction so that six springs, see spring 29, are formed. The free ends of the springs 29 are provided with an annular tooting in the form of an outer thread 30 for engagement of an annular tooting in the form of a thread provided on the inner wall of the bushing part. The rear part 27 has an outer thread 31 and at its end a collar 32. Outer thread 31 and collar 32 are divided into two segments 33, 34 (FIGS. 15, 16).

FIGS. 17 to 21 show the configuration of the union nut 6. The union nut 6 has at its inner side a ring stop or annular shoulder 35 provided on its front side with radial ribbing 36. The back of the shoulder 35 is provided with a stop 37 for limiting rotation; the stop 37 interacts with the rotary limitation stop 22 (FIG. 9). At least one cutout 35' is provided in the shoulder 35 for receiving the rotary limitation stop 22 (FIG. 9) when the union nut 6 is locked. The annular shoulder 35 interacts with the collar 4 of the housing 3; the collar 4 provides a counter ring stop for the annular shoulder 35. The ribbing 36 interacts with the ribbing 25 (FIG. 9). On its outer side, the union nut 6 is provided for improved handling with a ribbing 38. On the front side of the union nut 6, there are two threaded segments 39, 40 provided at the inner side; the threaded segments 39, 40 are matched to the outer thread 31 (FIG. 14) and are able to engage it.

Figure 22:
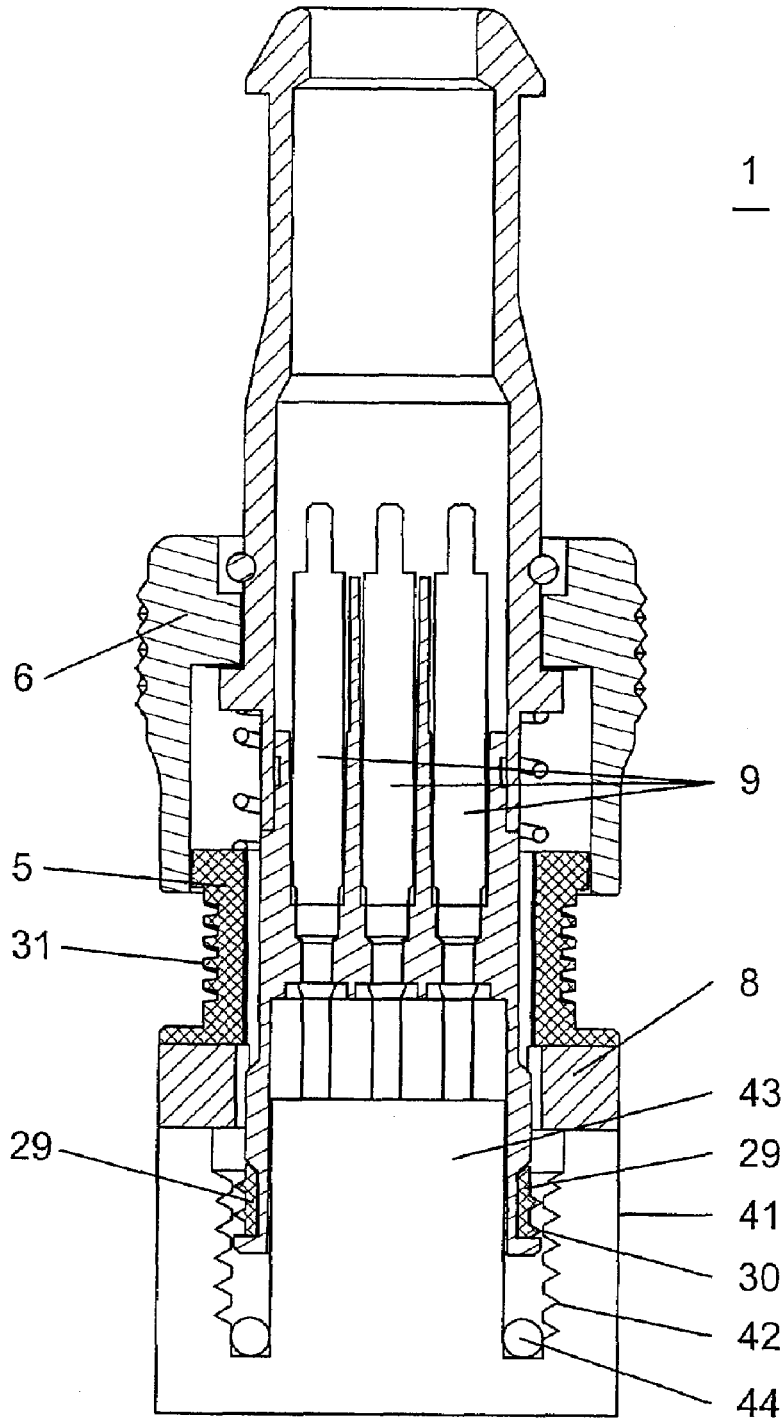
FIG. 22 is a longitudinal section of the plug-in connector according to the invention at the beginning of the locking action.

FIG. 22 shows in addition to the plug member 1 already illustrated in FIG. 1 also the bushing part 41 of a counter part (distributor) that is inserted into the plug member 1 without already being locked on the bushing part 41. The bushing part 41 is cylindrical and supports on its inner walls an inner thread 42 that is matched to the outer thread 30 and positioned opposite thereto. A cylindrical solid member 43 is centrally arranged in the bushing part 41 and surrounds the bushing contacts (not illustrated). The bushing contacts interact with the plug contacts 9. At the base of the solid body 43 an annular seal or gasket 44 is arranged. As a result of the configuration of the threaded lock sleeve 5, the union nut 6 cannot yet be rotated; it is still blocked by the lock sleeve 5. When further advancing the plug member 1, the contact carrier 2 loads the springs 29 of the threaded lock sleeve 5 so as to spread them apart. Since spreading is not possible in the position illustrated in FIG. 22, the threaded lock sleeve 5 is entrained to the next free thread turn of the outer thread 31. The rubber ring 8 is compressed and thus provides the required resistance.

Figure 23:
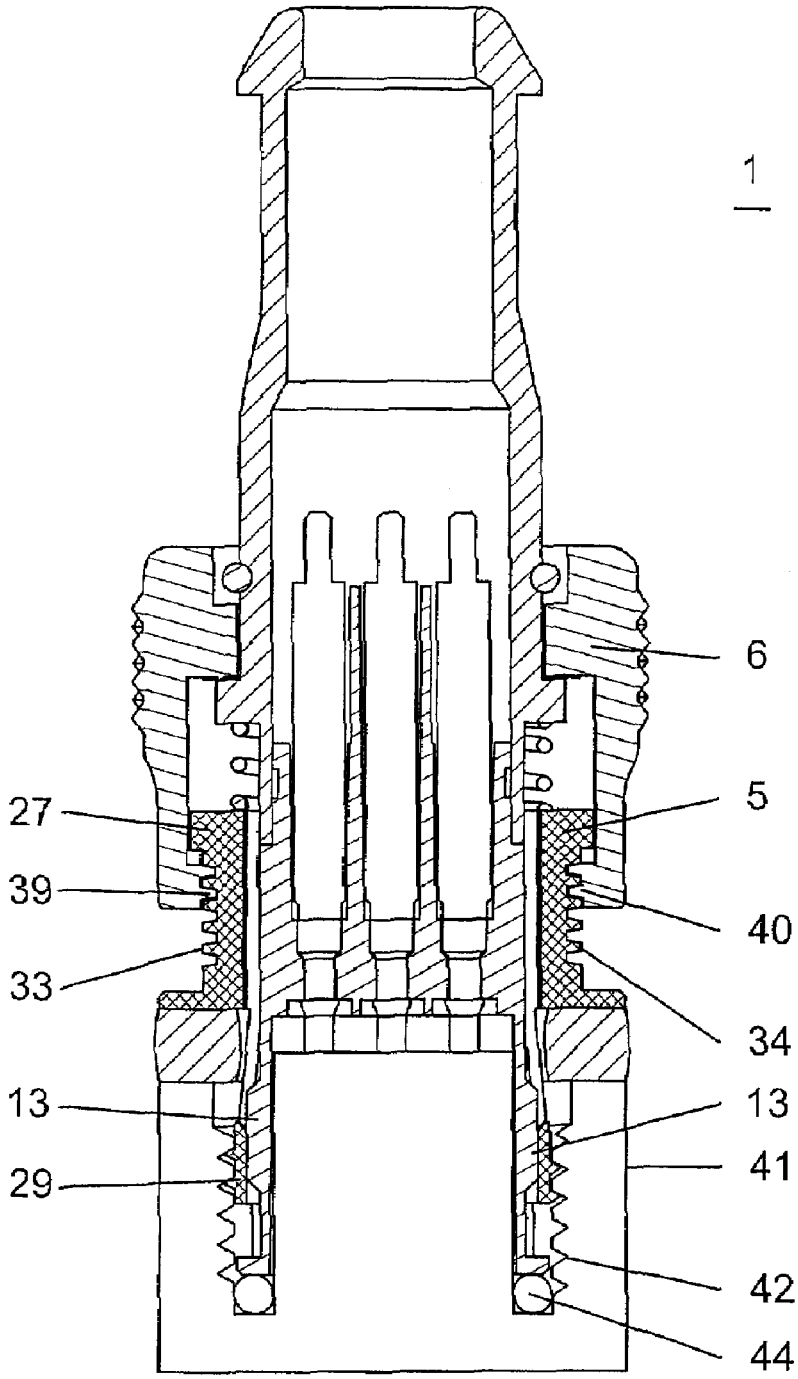
FIG. 23 is a longitudinal section of the plug-in connector according to the invention upon completion of the locking action.
Figure 24:
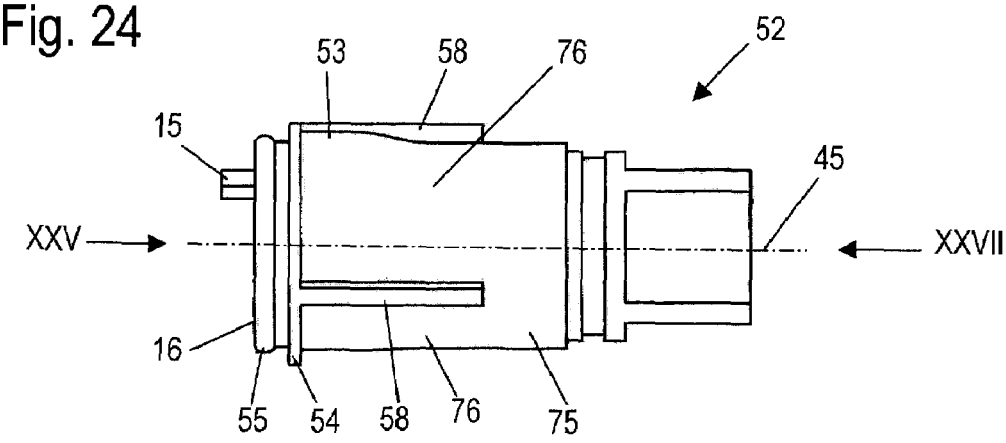
FIG. 24 is a side view of the contact carrier of the plug member.

In FIG. 23, the state of the plug-in connector is illustrated in which the plug member 1 is locked with the bushing part 41. The springs 29 are now spread apart by the actuating means in the form of the glide bars 13 as the plug member 1 is further advanced and engage positive-lockingly the inner thread 42 of the bushing part 41. The plug member 1 can now be advanced with minimal force expenditure up to the annular seal 44. Simultaneously, the union nut 6 is pushed across the rearward end 27 of the threaded lock sleeve 5. The locking action (stop 22 in cutout 35') of the union nut 6 is released so that it can now be rotated. The union nut 6 is now rotated to the right. The threaded sectors 39, 40 of the union nut 6 engage the threaded sectors 33, 34 of the threaded lock sleeve 5. Depending on the dimensions and design of the bushing part 41 (not standardized), this engagement can be realized within different turns of the thread. Upon tightening of the union nut 6 the plug member 1 is pulled farther into the bushing part 41 and pushes against the annular seal 44. In this way, the connection between the plug member and the bushing part provides a certain protection level, the so-called protection level IP67. The interaction between the ribbing 25 and the ribbing 36 on the contact surfaces of union nut 6 and the housing 3, respectively, ensures that the union nut 6 cannot become loose accidentally.

The locking connection that is illustrated in FIGS. 1 to 23 can also be provided on the inner thread 42 of the bushing part. In this case, the bushing part has springs that can be deflected radially inwardly and engage the outer thread of the contact carrier.

A further embodiment of a plug-in connector is illustrated in FIGS. 24 to 35. In this embodiment, the locking elements are also arranged on the contact carrier provided with the plug contacts and interact with a bushing part that has an inner thread. The inner thread can be arranged, for example, on a union nut of the bushing part.

Figure 25:
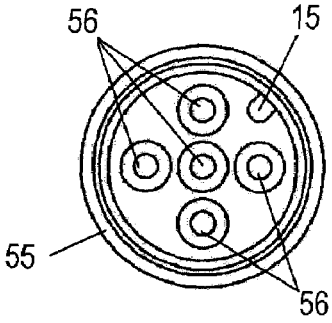
FIG. 25 a side view of the contact carrier or FIG. 24 viewed in the direction of arrow XXV of FIG. 24.
Figure 26:
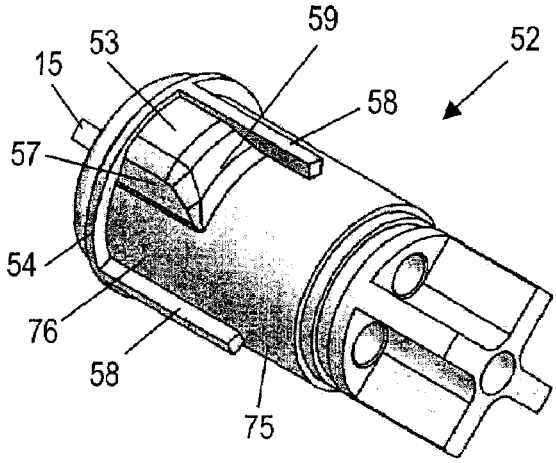
FIG. 26 is a perspective view of the contact carrier or FIG. 24.
Figure 27:
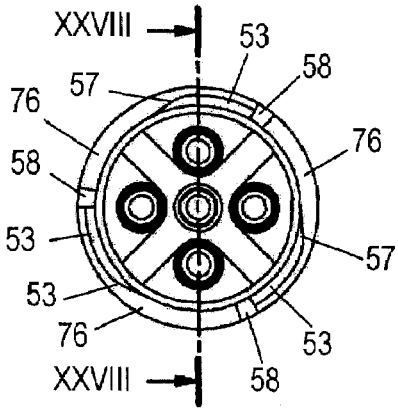
FIG. 27 is a side view of the contact carrier in the direction of arrow XXVII of FIG. 24.
Figure 28:
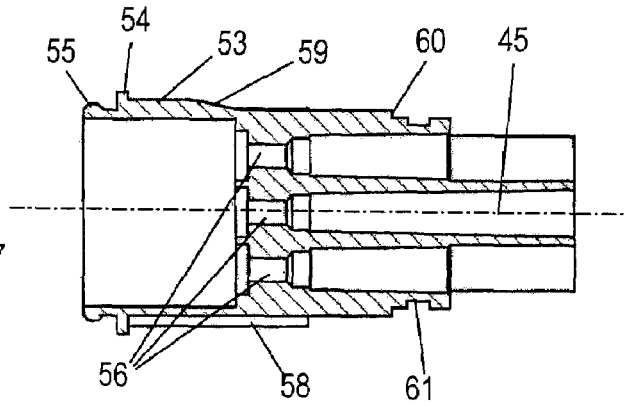
FIG. 28 is a section of the contact carrier along section line XXVIII-XXVIII of FIG. 27.
Figure 29:
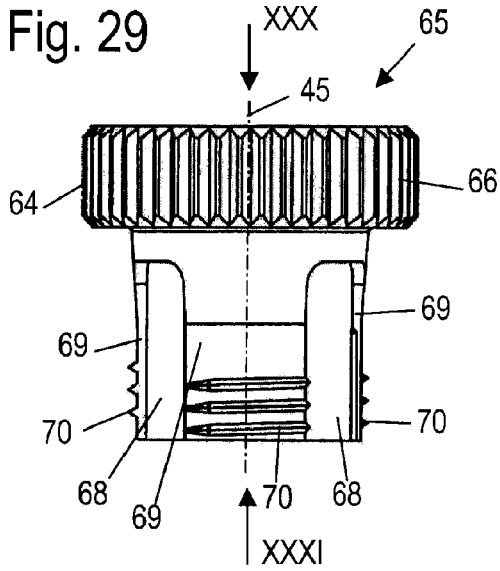
FIG. 29 is a side view of a lock sleeve of a plug member.
Figure 30:
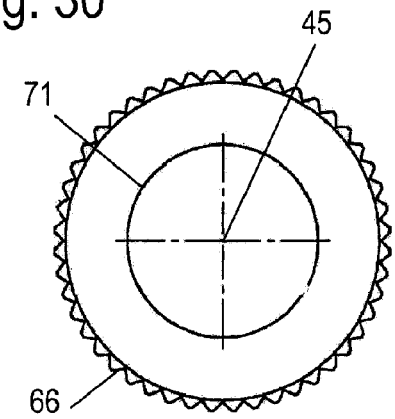
FIG. 30 is an end view onto the lock sleeve of FIG. 29 in the direction of arrow XXX in FIG. 29.

In FIGS. 24 through 28 a contact carrier 52 is shown that is a monolithic part and is made preferably of plastic material. Adjacent to the end face 16 of the contact carrier 52 that is facing the counterpart, the contact carrier 52 has a bead 55 serving for receiving a seal or gasket (not illustrated). Adjacent to the bead 55 a circumferentially extending step 54 is arranged on the base member 75 of the contact carrier 52. The step 54 projects radially outwardly and serves for supporting the seal or gasket to be arranged on the bead 55. The contact carrier 52 has three stops 58 (FIG. 27) that are formed as stays extending parallel to the longitudinal axis 45 of the plug member. The base member 75 of the contact carrier 52 is essentially cylindrical. The stops 58 are arranged on the outer circumference of the base member 75 and divide the circumference of the base member 75 into three identical circumferential sections 76. In each circumferential section 76 there is a radially projecting portion 53 that is arranged adjacent to the step 54 and extends in the circumferential direction approximately about half the circumferential length of the section 76. The projecting portion 53 extends up to one of the stops 58, respectively. As illustrated in FIG. 27, in a viewing direction onto the end of the contact carrier 52 remote from the end face 16, the projecting portions 53 are positioned in front of the stops 58 in the clockwise direction. Each projecting portion 53 has a contact slant 57 arranged in the circumferential direction at the end remote from the stop 58. As illustrated in FIG. 26 and FIG. 28, the projecting portions 53 have a slant 59 at their side facing away from the step 54.

On its end face 16, the contact carrier 52 has a positioning stay 15 for determining the rotational position relative to the counterpart. As illustrated in FIG. 25, the contact carrier 52 has five receptacles 56 for plug contacts (not illustrated in FIGS. 24 to 28). As shown in FIG. 28, a circumferential groove 61 as well as a collar 60 are provided on the end facing away from the counterpart.

Figure 31:
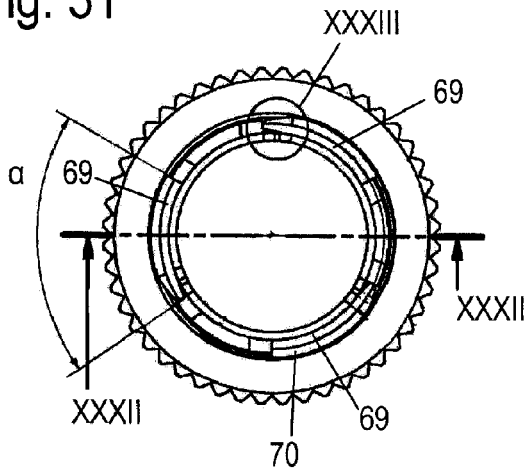
FIG. 31 is an end view of the lock sleeve in the direction of arrow XXXI of FIG. 29.

FIGS. 29 through 34 shows a lock sleeve 65 that is arranged on a support body in the form of the contact carrier 52 of FIGS. 24 to 28. The lock sleeve 65 has a collar 64 with larger diameter than the base member of the lock sleeve 65. The collar 64 has ribbing 66 on its circumference. In this way, the lock sleeve 65 can be easily rotated. The collar 64 of the lock sleeve 65 has an opening 71 that, relative to the base member of the lock sleeve 65, has a reduced diameter and has a transition at step 67 into the base member of the lock sleeve. At the end of the lock sleeve facing away from the collar 64, the lock sleeve has three slots 68 that extend parallel to the longitudinal axis 45. The webs that remain between the slots 68 form springs 69. The ends of the springs 69 facing away from the collar 64 have an outer thread 70, respectively, that is a right-hand thread. As illustrated in FIG. 31, the three springs 69 are distributed uniformly about the circumference of the lock sleeve 65. Each spring 69 extends about a circumferential angle $\alpha$ of preferably approximately 65 degrees.

Figure 33:
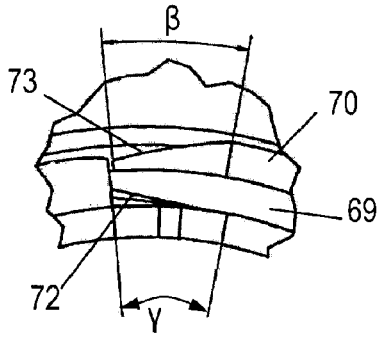
FIG. 33 shows the detail XXXIII of FIG. 31.
Figure 34:
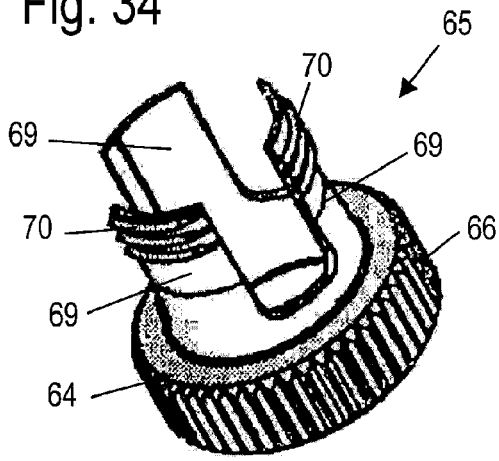
FIG. 34 is a perspective illustration of the lock sleeve.

In FIG. 31, the lock sleeve is shown in a direction viewed from the end facing away from the collar 64. The counterclockwise end of the spring 69 in this viewing direction is slanted (72). In FIG. 33 the slanted portion 72 is illustrated in a magnified view. The spring 69 is provided about an angle $\gamma$ with a slanted portion 72. The slanted portion 72 is arranged on the radially inwardly positioned side of the spring 69. The thread 70 has a contact slant 73 which is preferably embodied as a radius and extends about an angle $\beta$ that is preferably somewhat smaller than the angle $\gamma$. The angles $\beta$ and $\gamma$ are significantly smaller than the circumferential angle $\alpha$ about which the spring 69 extends. The angle $\beta$ can be, for example, 15 degrees and the angle $\gamma$ 16 degrees.

Figure 32:
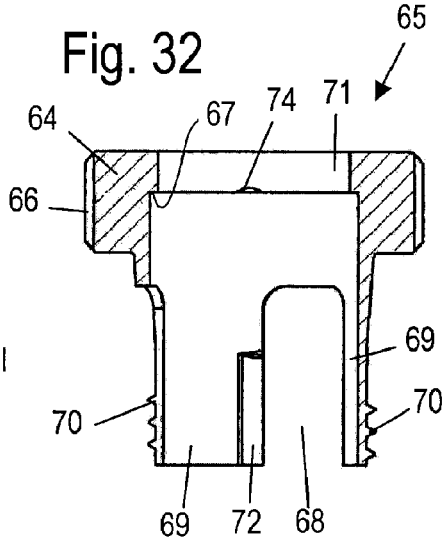
FIG. 32 is a section of the lock sleeve of FIG. 29 along the section line XXXII-XXXII of FIG. 31.
Figure 35:
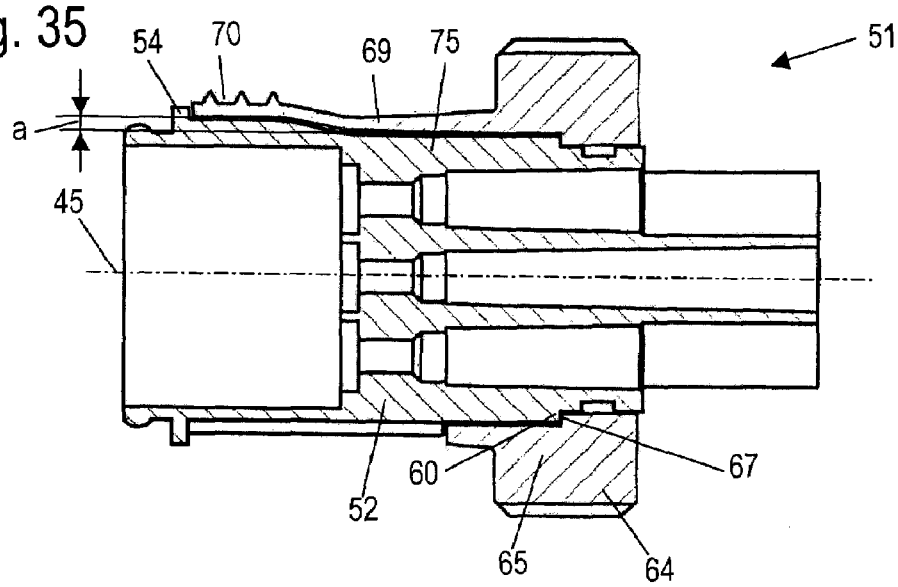
FIG. 35 is a plug member in a magnified section view.
Figure 36:
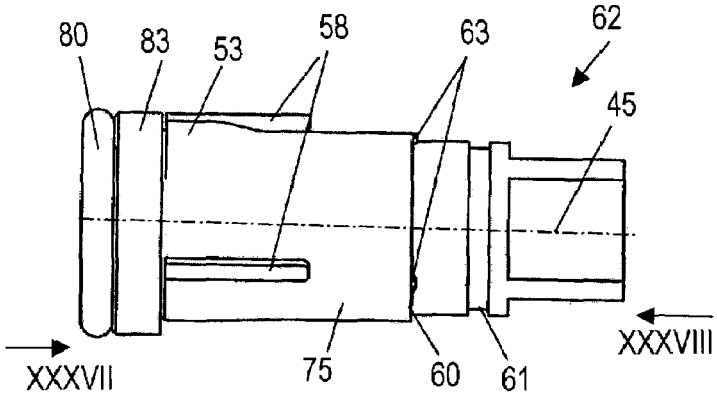
FIG. 36 is a side view of the contact carrier.
Figure 37:
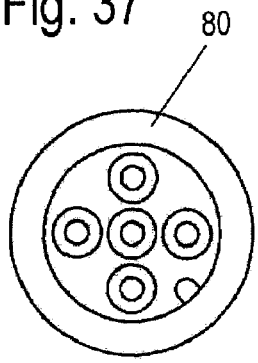
FIG. 37 is a side view of the contact carrier in the direction of arrow XXXVII of FIG. 36.
Figure 38:
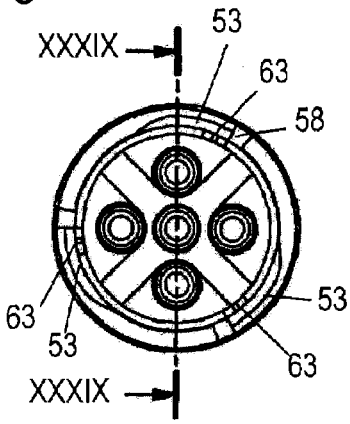
FIG. 38 is a side view of the contact carrier in the direction of arrow XXXVIII of FIG. 36.
Figure 39:
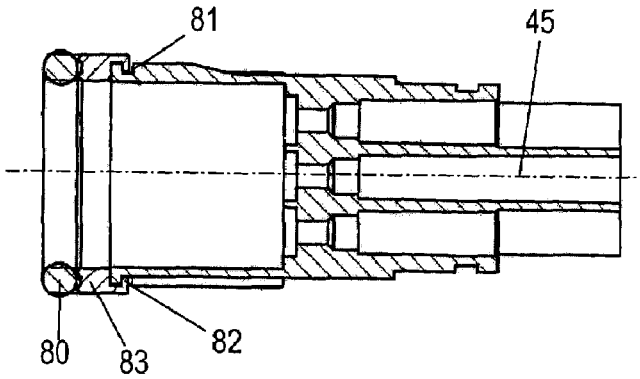
FIG. 39 is a section along the line XXXIX-XXXIX of FIG. 38.
Figure 40:
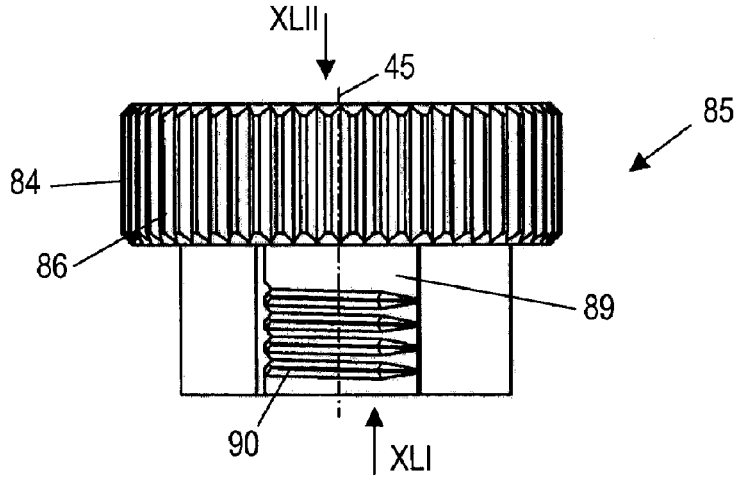
FIG. 40 shows another embodiment of a lock sleeve in a side view.

In FIG. 35 the plug member 51 comprised of the contact carrier 52 and the lock sleeve 65 is shown in the assembled state. In the assembled state, the lock sleeve 65 is pushed onto the contact carrier 52. The collar 64 is arranged on the end of the base member 75 of the contact carrier 52 facing away from the counterpart. Preferably, the step 67 of the lock sleeve 65 rests against the collar 60 of the contact carrier 52. As illustrated in FIG. 32, the step 67 has locking recesses 74 into which locking noses (not illustrated) of the contact carrier 52 project. The locking noses and looking recesses 74 preferably define two predetermined rotational positions between the contact carrier 52 and the lock sleeve 65, i.e., the release position and the locking position. In the release position, the springs 69 rest against the base member 75 of the contact carrier 52 and project preferably to the step 54. The stops 58 are arranged in a slot 68 of the lock sleeve 65. Upon rotation of the lock sleeve 65 to the right, when looking onto the counterpart from the end of the contact carrier 52 facing away from the counterpart, the slanted portions 72 of the springs 69 engage the contact slants 57 of the projecting portions 53. Actuating means in the form of the projecting portions 53 actuate the springs 69 and force them radially outwardly. In FIG. 35, the springs 69 are deflected by a radial deflection a in the radial direction relative to the longitudinal axis 45 of the plug member. In this way, the outer thread 70 engages a counter thread (not illustrated) of the counterpart. The slanted portion 73 of the thread 70 illustrated in FIG. 33 ensures that the outer thread 70 will not jam or can't relative the counter thread of the counterpart but will engage the thread turns. Upon rotation of the lock sleeve 65, a locking action between plug member and counterpart can be achieved in this way. By rotating the lock sleeve 65 in the opposite direction, the springs 69 will disengage the projecting portions 53 and, because of their inherent elasticity will return into their initial position, i.e., will be retracted into a position within the base member 75 of the contact carrier 52. In this way, plug member and counterpart can be inserted into one another and released from one another again without any impairment in the direction of the longitudinal axis 45 of the plug member.

One embodiment of a contact carrier 62 is illustrated in FIGS. 36 to 39. The configuration of the contact carrier 62 corresponds essentially to that of contact carrier 52 illustrated in FIGS. 24 to 28. Same elements are identified by same reference numerals. On the collar 60 of the contact carrier 62 three locking noses 63 (FIG. 38) are arranged that cooperate with the locking recess 74 of the lock sleeve 65 illustrated in FIG. 32 and determine the release position and locking position of the lock sleeve 65.

On the end face 16 the contact carrier 62 has a sealing member 80 that is in the form of a sealing ring or gasket and is secured by means of a holder 83 on the base members 75 of the contact carrier 62. As illustrated in the section view of FIG. 39, the contact carrier 62 has for this purpose a circumferential groove 81 that is engaged by a collar 82 of the holder 83. The seal effects a sealing action of the connection of plug member and counterpart. For connecting the contact carrier 62 and the counterpart, the contact carrier 62 is inserted into the counterpart and the lock sleeve 65 (not illustrated in FIGS. 36 to 39) is rotated so that the springs 69 will come to rest against the projecting portions 53 and are in this way radially deflected in the outward direction. Since the lock sleeve 65 has a right-hand thread, a rotation of the lock sleeve 65 causes the contact carrier 62 to be forced against the counterpart so that the seal 80 is pressed against the counterpart and loaded with a predetermined force. The pressing force on the seal 80 can be determined by appropriately positioning the stops 58. In this way, a simple and safe connection between the plug member and the counterpart is made possible.

Figure 41:
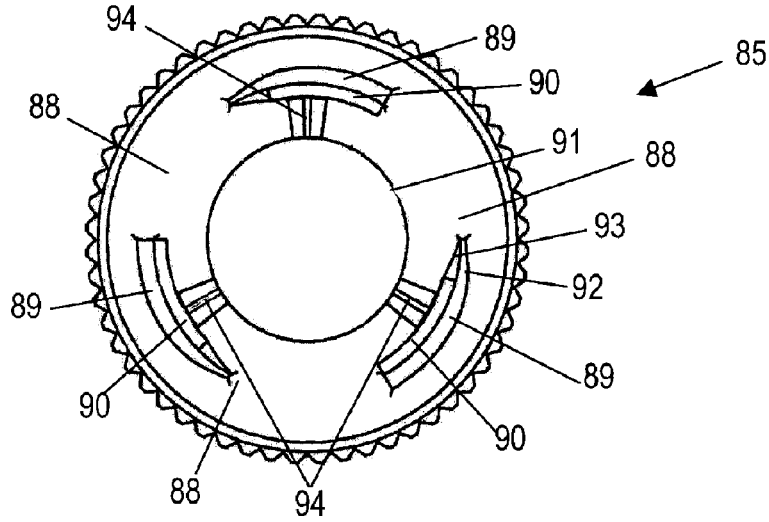
FIG. 41 is an end view of the lock sleeve of FIG. 40 in the direction of arrow XLI of FIG. 40.
Figure 42:
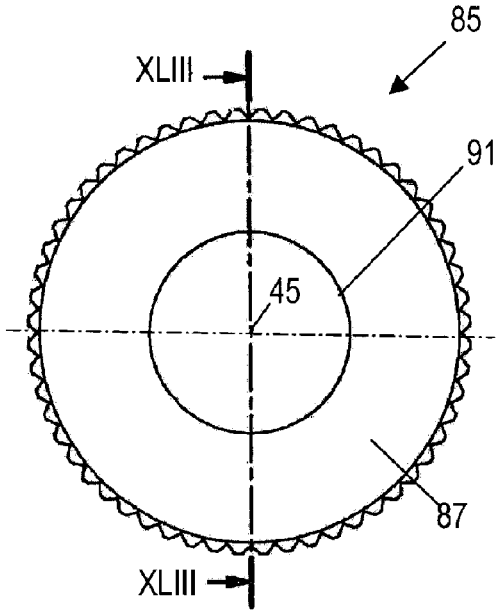
FIG. 42 is an end view onto the lock sleeve of FIG. 40 in the direction of arrow XLII of FIG. 40.
Figure 43:
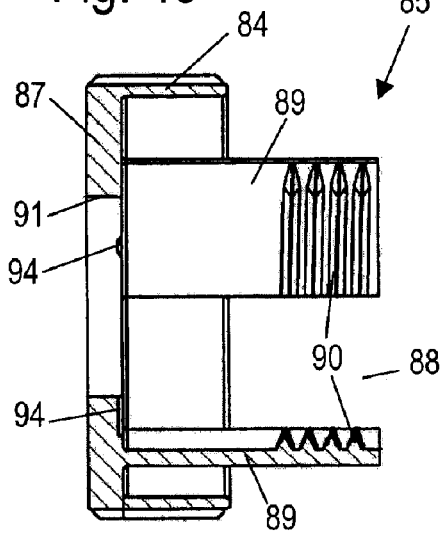
FIG. 43 is a section along the section line XLIII-XLIII of FIG. 42.

In FIGS. 40 to 43, an embodiment of a lock sleeve 85 is shown that is provided with an inner thread 90. The lock sleeve 85 has a collar 84 having at its outer circumference a ribbing 86 that enables excellent actuation of the lock sleeve 85. As shown in FIG. 41, the lock sleeve 85 has three springs 89 formed by slots 88 in the base member of the lock sleeve. The slots 88 extend across approximately the entire length of the lock sleeve 85 to a bottom 87 of the lock sleeve. The springs 89 are thus embodied as circular segment-shaped stays. The springs 89 are springy because of the inherent elasticity of the material, preferably a plastic material. The bottom 87 of the lock sleeve 85 has a central opening 91. In the area between the springs 89 and the opening 91 the bottom 87 of the lock sleeve 85 has a locking recess 94, respectively, that extends in the radial direction.

The thread 90 is a right-hand thread. In FIG. 41, the lock sleeve 85 is illustrated in a view from the end remote from the collar 84. In this illustration, the counterclockwise spring edges of the springs 89 have at their radial outer side a contact slant 92. The inner thread 90 has at the radial inner side a slant 93.

Figure 44:
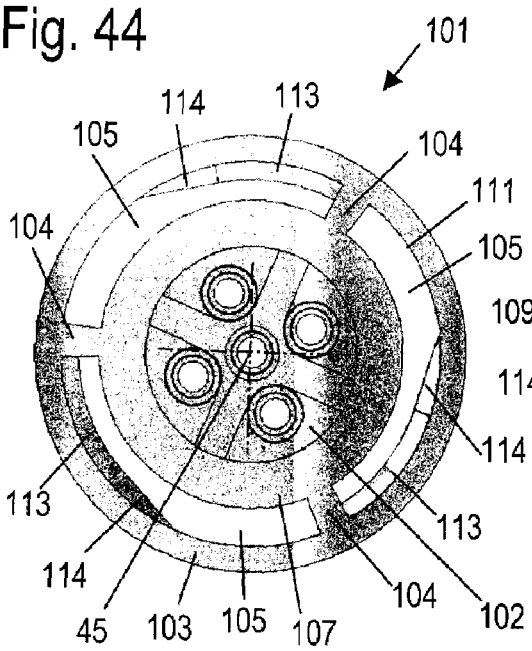
FIG. 44 is an end view of a bushing part.
Figure 45:
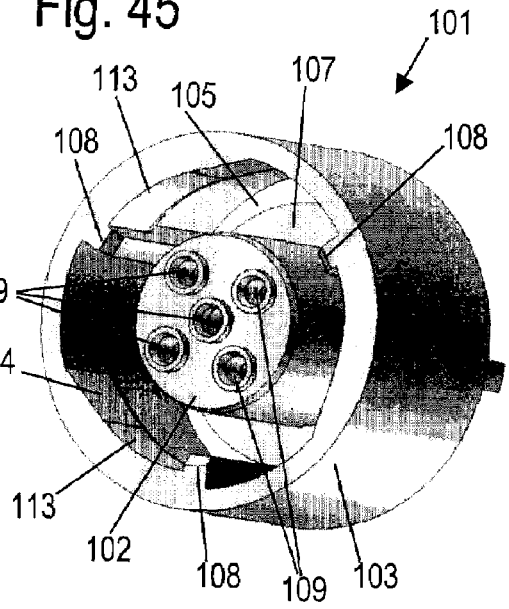
FIG. 45 is a perspective illustration of the bushing part of FIG. 44.

A support body in the form of bushing part 101 is illustrated in FIGS. 44 and 45; the lock sleeve 85 illustrated in FIGS. 40 to 43 can arranged thereon. The bushing part 101 has a bushing 102 having formed threat contact bushings 109. Radially outside of the bushing 102 and coaxially to the bushing 102, an actuating sleeve 103 is arranged. A bottom 107 is arranged on the bushing 102 on which the actuating sleeve 103 is secured by means of three stays 104. Three openings 105 are formed between the bottom 107 and the actuating sleeve 103 in the intermediate space between the stays 104. In the mounted state, the springs 89 of the lock sleeve 85 project through the openings 105. As illustrated in FIG. 45, the actuating sleeve 103 has at its inner circumference three stops 108 that extend parallel to the longitudinal axis 45 of the plug member and are arranged in the area of a stay 104, respectively. The stops 108 are formed as longitudinal stays.

On the inner circumference 11 of the actuating sleeve 103 actuating means in the form of projecting portions 113 are provided between two stays 108, respectively. In FIG. 44 the bushing part 101 is illustrated in a view in a direction onto the counterpart from the end facing away from the counterpart. In this viewing direction, the projecting portions 113 are arranged so as to neighbor in a clockwise direction the stay 104 and the stop 108. On the side that is facing away from the stop 108 or stay 104, each projecting portion 113 has a contact slant 114. The contact slant 114 is thus arranged in the clockwise direction in front of the projecting portion 113.

Figure 46:
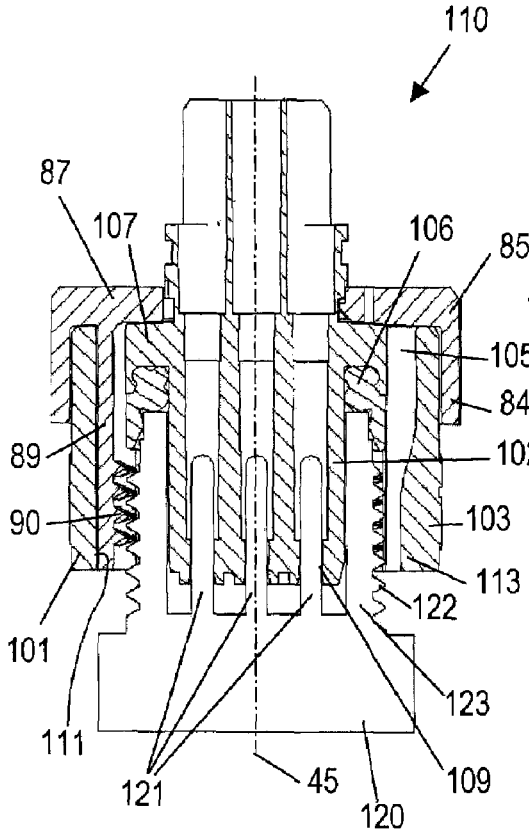
FIG. 46 shows a plug-in connector with locking elements in the release position shown in section.

In FIG. 46, a plug-in connector 110 is shown. The plug-in connector 110 has a bushing part 101 on which the lock sleeve 85 is arranged. The bottom 87 of the lock sleeve 85 is arranged on the side of the bottom 107 of the bushing part 101 facing away from the counterpart. The springs 89 project through the openings 105 of the bushing part 101. The actuating sleeve 103 is positioned radially outside of the springs 89 between the springs 89 and the collar 84 of the lock sleeve 85. The springs 89 are positioned on the inner circumference 11 of the actuating sleeve 103 in an area that has no projecting portion 113. The springs 89 extend approximately parallel to the longitudinal axis 45 of the plug member.

The bushing part 101 receives a plug member 120 as the counterpart; this is illustrated schematically in FIG. 46. The plug member 120 has plug contacts 121 that project into the contact bushing 109 of the bushing 102. The plug member 120 has a threaded sleeve 123 that is provided with an outer thread 122. On the bottom 107 of the bushing part 101 a seal 106 is arranged against which the threaded sleeve 123 rests. In the release position illustrated in FIG. 46, the thread 90 of the lock sleeve 85 does not engage the outer thread 122 of the plug member 120. In this way, the plug member 120 can be inserted without impairment into the bushing part 101 until the threaded sleeve 123 rests against the seal 106. Subsequently, the connection of the two plug members can be locked.

Figure 47:
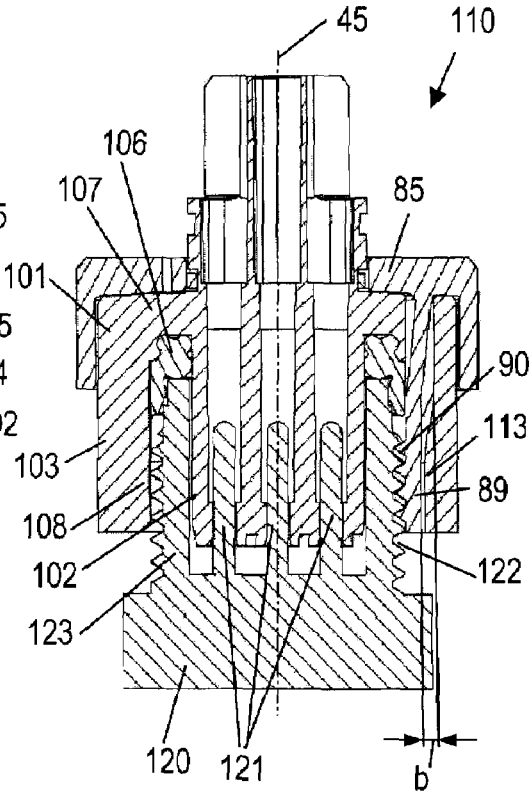
FIG. 47 shows the plug-in connector in the locked position of plug member and counterpart in section

In FIG. 47, the plug-in connector is shown in the locked positioned. The lock sleeve 85 has been rotated in the clockwise direction relative to the position illustrated in FIG. 46 when viewing the sleeve in a direction from the bushing part onto the plug member. The contact slants 92 of the springs 89 have thus engaged the contact slants 114 on the projecting portions 113 and the springs 89 have been radially inwardly deflected by means of the actuating sleeve 103. As shown in FIG. 47, the thread 90 of the springs 89 engages the thread 122 of the threaded sleeve 123. The springs 89 have been radially deflected in the inward direction by a radial deflection b. As a result of the rotation of the threaded lock sleeve 85, the threads 90 and 122 have been rotated farther into one another so that the bushing part 101 and the plug member 120 are forced more against one another and the seal 106 has been compressed. The travel by which the seal has been farther compressed is determined by the position of the stops 108 on the actuating sleeve 103. The contact slant 93 on the springs 89 illustrated in FIG. 41 ensures that the thread 90 engages the thread 122 of the threaded sleeve 123.

It is also possible to provide a different number of locking elements. The contact carrier, bushing parts, and sleeves are preferably made of plastic material.

While specific embodiments of the invention have been shown and described in detail to illustrate the inventive principles, it will be understood that the invention may be embodied otherwise without departing from such principles.

What is claimed is:

1. A plug-in connector comprising:

a plug member;

a locking device for securing the plug member on a counterpart;

the locking device comprising at least one locking element having a release position and a locking position, wherein in the release position the plug member is removable from the counterpart and wherein in the locking position the plug member and the counterpart are locked relative to one another;

an actuating means acting on the locking device to move the at least one locking element from the release position into the locking position in a radial direction relative to a longitudinal axis of the plug member;

wherein the at least one locking element is disposed on a support body of the plug member so as to be movable in at least one direction;

wherein the actuating means is a projecting portion of the support body.

2. The plug-in connector according to claim 1, wherein the actuating means holds the at least one locking element in the locking position in a radially deflected position.

3. The plug-in connector according to claim 1, wherein the at least one locking element is arranged on the plug member and is adapted to interact with a threaded section provided on the counterpart, wherein the at least one locking element in the locking position engages the threaded section and in the release position is disengaged from the threaded section.

4. The plug-in connector according to claim 1, wherein the at least one locking element is springy and is in the release position when in an unloaded state.

5. The plug-in connector according to claim 1, wherein the plug member comprises a lock sleeve, wherein the at least one locking element is provided on the lock sleeve, wherein the lock sleeve is supported on the support body so as to be movable in the at least one direction.

6. The plug-in connector according to claim 5, wherein several of the at least one locking element are provided and distributed uniformly in a circumferential direction of the lock sleeve.

7. The plug-in connector according to claim 6, wherein the lock sleeve has longitudinal slots and springs that are delimited by the longitudinal slots, wherein the springs are the locking elements.

8. The plug-in connector according to claim 5, wherein the support body of the plug member comprises a contact carrier comprising plug contacts, wherein the lock sleeve is supported on the contact carrier and wherein the at least one locking element in the locking position is deflected radially in an outward direction.

9. The plug-in connector according to claim 8, wherein the projecting portion is arranged on an outer circumference of the contact carrier.

10. The plug-in connector according to claim 5, wherein the support body is a bushing part and wherein the at least one locking element in the locking position is radially deflected in an inward direction.

11. The plug-in connector according to claim 10, further comprising an actuating sleeve, wherein the at least one locking element is positioned inwardly of an inner circumference of the actuating sleeve, and wherein the projecting portion is arranged on the inner circumference of the actuating sleeve.

12. The plug-in connector according to claim 5, wherein the lock sleeve is rotatable about the support body.

13. The plug-in connector according to claim 12, comprising at least one stop for limiting a relative rotational movement between the lock sleeve and the support body.

14. A plug-in connector comprising:

a plug member;

a locking device for securing the plug member on a counterpart;

the locking device comprising at least one locking element having a release position and a locking position, wherein in the release position the plug member is removable from the counterpart and wherein in the locking position the plug member and the counterpart are locked relative to one another;

an actuating means acting on the locking device to move the at least one locking element from the release position into the locking position in a radial direction relative to a longitudinal axis of the plug member;

wherein the plug member comprises a lock sleeve and a support body, wherein the at least one locking element is provided on the lock sleeve, wherein the lock sleeve is supported on the support body so as to be movable in at least one direction;

wherein the support body is a bushing part and wherein the at least one locking element in the locking position is radially deflected in an inward direction;

an actuating sleeve, wherein the at least one locking element is positioned inwardly of an inner circumference of the actuating sleeve, and wherein the actuating means is a projecting portion of the inner circumference of the actuating sleeve;

wherein the actuating sleeve is a monolithic part of the bushing part.

15. A plug-in connector comprising:

a plug member;

a locking device for securing the plug member on a counterpart:

the locking device comprising at least one locking element having a release position and a locking position, wherein in the release position the plug member is removable from the counterpart and wherein in the locking position the plug member and the counterpart are locked relative to one another;

an actuating means acting on the locking device to move the at least one locking element from the release position into the locking position in a radial direction relative to a longitudinal axis of the plug member;

wherein the plug member is a plug having plug contacts and wherein the counterpart is a bushing part having bushing contacts, wherein the plug comprises a contact carrier surrounding the plug contacts and comprises a lock sleeve that is supported on the contact carrier so as to be movable in a longitudinal direction of the contact carrier but immobile in a radial direction of the contact carrier, wherein the lock sleeve has an outer thread, wherein the lock sleeve has a terminal area for engaging the bushing part, wherein the terminal area is radially moveable and defines the at least one locking element, wherein the actuating means are spreading means arranged on a leading end of the contact carrier to be inserted into the bushing part and acts on the at least one locking element to radially spread the terminal area and forcing the terminal area against an inner wall of the bushing part pushed onto the plug to lock the plug and the bushing part relative to one another.

16. The plug-in connector according to claim 15, wherein the terminal area of the lock sleeve has longitudinal slots and springs that are delimited by the longitudinal slots, wherein the spreading means are longitudinal bars interacting with the springs, wherein the springs have spring ends with an annular toothing and wherein the bushing part has an annular toothing matching in regard to shape and orientation the annular toothing of the spring ends, wherein the annular toothings of the spring ends and of the bushing part are threads.

17. The plug-in connector according to claim 16, wherein the plug further comprises a union nut having an annular shoulder interacting with the contact carrier and an inner thread interacting with an outer thread of the lock sleeve, wherein, when rotating the union nut, the contact carrier is axially moved relative to the union nut and moved farther into the bushing part and against an annular seal of the bushing part.

18. The plug-in connector according to claim 17, wherein the outer thread of the lock sleeve is divided into segments and wherein the inner thread of the union nut is divided into segments and wherein the segments of the lock sleeve and of the union nut are configured such that the lock sleeve and the union nut are axially slidable within one another when the inner thread of the union nut and the outer thread of the lock sleeve are not engaged.

19. The plug-in connector according to claim 17, wherein the plug further comprises a sleeve-shaped housing connected to an end of the contact carrier remote from the leading end of the contact carrier, wherein the sleeve-shaped housing has a collar having a first side that is facing away from the bushing part and provides a counter ring stop for the annular shoulder of the union nut, wherein the annular shoulder and the counter ring stop each have a radial ribbing, wherein the plug further comprises a coil spring arranged between the lock sleeve and a second side of the collar facing the bushing part.

20. The plug-in connector according to claim 19, wherein the union nut is disengaged from the outer thread of the lock sleeve when the springs are not spread apart by the spreading means, wherein the sleeve-shaped housing and the union nut have locking means for locking the union nut relative to the sleeve-shaped housing when the springs are not spread apart, and wherein the sleeve-shaped housing and the union nut have stops for limiting rotation.

* * * * *